US010174916B2

(12) United States Patent
Wronski et al.

(10) Patent No.: US 10,174,916 B2
(45) Date of Patent: Jan. 8, 2019

(54) ROTATABLE JUNCTION BOX ASSEMBLY

(71) Applicant: Cooper Technologies Company, Houston, TX (US)

(72) Inventors: Grzegorz Wronski, Peachtree City, GA (US); Zhihong Lin, Shanghai (CN)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 15/488,609

(22) Filed: Apr. 17, 2017

(65) Prior Publication Data

US 2017/0219190 A1 Aug. 3, 2017

Related U.S. Application Data

(63) Continuation of application No. 14/242,552, filed on Apr. 1, 2014, now Pat. No. 9,625,109.

(60) Provisional application No. 61/891,284, filed on Oct. 15, 2013.

(51) Int. Cl.

| | |
|---|---|
| ***F21V 21/04*** | (2006.01) |
| ***F21S 8/02*** | (2006.01) |
| *F21V 21/02* | (2006.01) |
| *F21V 21/03* | (2006.01) |
| *F21V 21/06* | (2006.01) |

(52) U.S. Cl.

CPC ..... *F21V 21/04* (2013.01); *F21S 8/02* (2013.01); *F21S 8/026* (2013.01); *F21V 21/042* (2013.01); *F21V 21/047* (2013.01); *F21V 21/02* (2013.01); *F21V 21/03* (2013.01); *F21V 21/049* (2013.01); *F21V 21/06* (2013.01); *Y10T 29/49963* (2015.01)

(58) Field of Classification Search

None

See application file for complete search history.

(56) References Cited

U.S. PATENT DOCUMENTS

| | | | | |
|---|---|---|---|---|
| 6,779,910 | B1 | 8/2004 | Pelton | |
| 8,480,268 | B2 | 7/2013 | Wilson | |
| 2003/0161155 | A1* | 8/2003 | Caluori | F21S 8/02 362/365 |
| 2003/0223240 | A1 | 12/2003 | Houle | |
| 2007/0181764 | A1 | 8/2007 | Fehrenbach | |
| 2014/0307445 | A1 | 10/2014 | Highbridge | |

FOREIGN PATENT DOCUMENTS

| | | |
|---|---|---|
| CN | 1170455 | 1/1998 |

OTHER PUBLICATIONS

Thomas Lighting; Product specification; PS5 5" Recessed Housing; Dec. 26, 2013.

Thomas Lighting; Product specification; PS5RM; 5" Recessed Housing; Jun. 12, 2013.

Thomas Lighting; Product specification; PS1RM; 6" Recessed Housing; Jun. 12, 2013.

Thomas Lighting; Product specification; PS1 6" Recessed Housing; Jun. 12, 2013.

(Continued)

*Primary Examiner* — Andrew Coughlin

(74) *Attorney, Agent, or Firm* — King & Spalding LLP

(57) ABSTRACT

A lighting fixture structure for a recessed lighting fixture includes a housing and a junction box. The lighting fixture structure further includes an arm. The arm is attached to the housing and to the junction box. The arm is rotatably attached to the housing.

20 Claims, 11 Drawing Sheets

(56) References Cited

OTHER PUBLICATIONS

Juno Lighting; Product specification; 6" Deluxe Universal TC Remodel Housing; TC2R; Aug. 2009.
Juno Lighting; Product specification; 6" Economy Universal IC Remodel Housing; IC22R; Oct. 2009.
Nora Lighting; Product specification; NHRIC-504QAT; 5" IC Air-Tight Line Voltage Remodel Housing; Jan. 2, 2002.
WAC Lighting; Product specification; R-603D-R-ICA; 6" Line Voltage Remodel Housing 120V-IC Rated-Airtight Ready; Apr. 2014.
Prescolite; LiteBox-Light Commercial and Residential Downlights; Catalog; Jan. 2009.
Lithonia Lighting; Residential Recessed Downlighting Guide; Feb. 2014.

* cited by examiner

ROTATABLE JUNCTION BOX ASSEMBLY

RELATED APPLICATION

The present application is a continuation of and claims priority to U.S. patent application Ser. No. 14/242,552, titled "Rotatable Junction Box Assembly," and filed Apr. 1, 2014, which claims priority under 35 U.S.C. § 119(e) to U.S. Provisional Patent Application No. 61/891,284, titled "Rotatable Junction Box Assembly, Interconnecting Luminaire Housing Ends and Luminaire Retention," and filed on Oct. 15, 2013. The foregoing applications are hereby incorporated herein by reference in their entirety.

TECHNICAL FIELD

The present disclosure relates generally to lighting fixtures, and more particularly to a rotatable junction box assembly that includes a junction box and an arm.

BACKGROUND

An electrical junction box is typically used with a recessed luminaire (i.e., a recessed lighting fixture). For example, a junction box may be used to contain electrical connections to conceal the electrical connections from view as well as to reduce risk associated with exposed electrical connections. Typically, a junction box is directly or indirectly attached to a lighting fixture housing. For example, the junction box may be directly attached to the lighting fixture housing or may be attached to an arm that is fixedly attached to the housing.

To install a lighting fixture (e.g., a recessed lighting fixture) in a structure such as a ceiling, the junction box, the arm, and the housing are typically maneuvered through an opening in a structure such as a ceiling. Because the arm and the junction box are fixedly attached to the housing, the arm typically needs to be long enough to enable adequate maneuvering of the junction box, the arm, and the housing for the installation of the lighting fixture. However, the size of the arm may be limited by the available space behind the structure, such as the space behind the ceiling. Further, installation of a light fixture with fixed arm and junction box may be relatively time consuming. Thus, there is a need for a lighting fixture structure that reduces the time and cost of installing a recessed lighting fixture.

SUMMARY

This present disclosure relates to a rotatable junction box assembly. In some example embodiments, a lighting fixture structure for a recessed lighting fixture includes a housing and a junction box. The lighting fixture structure further includes an arm. The arm is attached to the housing and to the junction box. The arm is rotatably attached to the housing.

In another example embodiment, a recessed lighting fixture includes a light source and a housing. The light source is disposed in the housing. The recessed lighting fixture further includes a junction box and an arm. The arm extends between the housing and the junction box. The arm is attached to the housing and to the junction box. The arm is rotatably attached to the housing.

In another example embodiment, a method of assembling a lighting structure includes attaching a junction box to an arm. The method further includes attaching the arm rotatably to a housing. The method also includes routing one or more electrical wires between the junction box and the housing.

These and other aspects, objects, features, and embodiments will be apparent from the following description and the claims.

BRIEF DESCRIPTION OF THE FIGURES

Reference will now be made to the accompanying drawings, which are not necessarily drawn to scale, and wherein.

Figure 1:
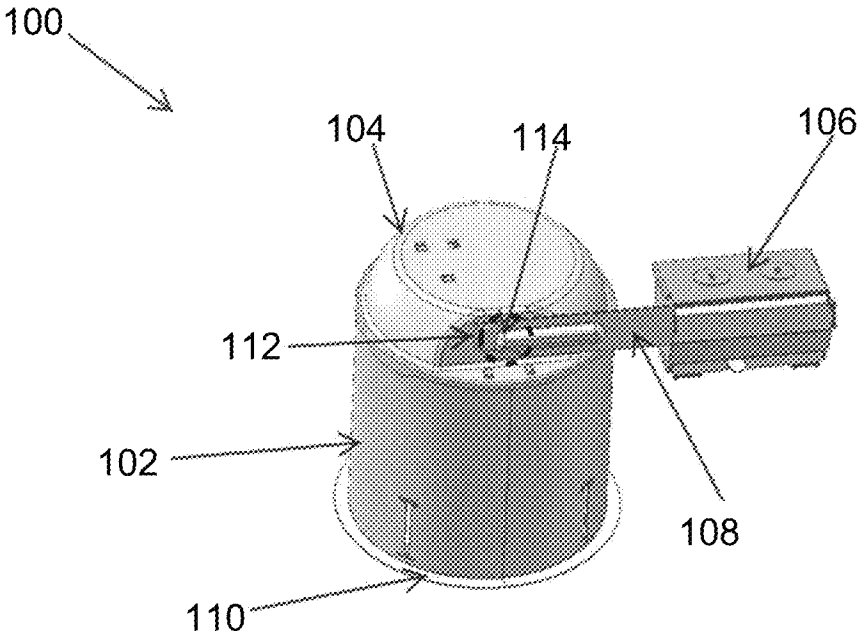
FIG. 1 illustrates a lighting fixture structure including rotatably attached arm and junction box in accordance with an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, reference numerals designate like or corresponding, but not necessarily identical, elements.

DETAILED DESCRIPTION OF EXAMPLE EMBODIMENTS

In the following paragraphs, particular embodiments will be described in further detail by way of example with reference to the figures. In the description, well known components, methods, and/or processing techniques are omitted or briefly described. Furthermore, reference to various feature(s) of the embodiments is not to suggest that all embodiments must include the referenced feature(s).

Turning now to the drawings, FIG. 1 illustrates a lighting fixture structure 100 including a rotatably attached arm and junction box in accordance with an example embodiment. In some example embodiments, the lighting fixture structure 100 includes a housing 102 that has a housing top 104. For example, the housing top 104 may be attached to the rest of the housing 102 by one or more fasteners (not shown) or other means, such as soldering, known to those of ordinary skill in the art. As illustrated in FIG. 1, the housing top 104 may be positioned at an end of the housing 102. In some example embodiments, the housing 102 including the housing top 104 may be integrally formed as a single piece structure.

The lighting fixture structure 100 further includes a junction box 106 and an arm 108. As illustrated in FIG. 1, the arm 108 extends between the junction box 106 and the housing 102. In some example embodiments, the lighting fixture structure 100 also includes a flange 110. For example, the flange 110 may be integrally formed with the housing 102. Alternatively, the flange 110 may be a ring or another similar structure that is attached to the housing 102 by means such as fasteners or by soldering. The flange 110 may abut against a ceiling or another similar structure when the lighting fixture structure 100 is installed as described below.

In some example embodiments, the arm 108 is rotatably attached to the housing 102. For example, the arm 108 may be rotatably attached to the housing top 104 of the housing 102. To illustrate, the arm 108 may be attached to the housing top 104 proximal to an end portion 112 of the arm 108 such that the arm 108 can rotate about an attachment area 114 of the lighting fixture structure 100. In some example embodiments, the junction box 106 is fixedly attached to the arm 108 such that the junction box 106 rotates along with the arm 108. For example, the junction box 106 may be attached to the arm 108 using one or more fasteners or other means known to those of ordinary skill in the art.

In some example embodiments, the junction box 106 may be attached to the arm 108 distal from the end portion 112 of the arm 108. To illustrate, the junction box 106 may be attached to the arm 108 proximal to another end portion of the arm 108 that is opposite to the end portion 112. The junction box 106 may also be attached to a portion of the arm 108 such that a portion of the arm 108 is positioned within the junction box 106 as illustrated in FIG. 1.

In some example embodiments, the junction box 106 may be attached to the arm 108 such that junction box 106 does not come in direct physical contact with the housing 102. To illustrate, the junction box 106 may be attached to a portion of the arm 108 such that the arm 108 can be rotated to a position where the arm 108 is substantially perpendicular to a vertical axis extending through the attachment area 114. In some alternative embodiments, the junction box 106 may be in physical contact with the housing top 104 or with another portion of the housing 102 without departing from the scope of this disclosure.

In some example embodiments, the housing 102 may rotate about the attachment area 114. For example, the arm 108 along with the junction box 106 may be rotationally fixed while the housing 102 is rotated about the attachment area 114. Alternatively, both the housing 102 and the arm 108 may rotate about the attachment area 114 as needed.

In some example embodiments, the housing 102 may be made entirely or substantially from sheet metal such as aluminum sheet metal. Similarly, the junction box 106 and the arm 108 may also be made entirely or substantially from sheet metal. For example, the sheet metal may be aluminum sheet metal. Alternatively, the sheet metal may be pre-galvanized or hot-dip galvanized steel instead of aluminum. In some example embodiments, the housing 102, the junction box 106, and/or the arm 108 may be made by a stamping process, a molding process, or other methods known to those of ordinary skill in the art. In some example embodiments, the housing 102, the arm 108, and the junction box 106 may be made using injection molded plastic components.

Figure 6:
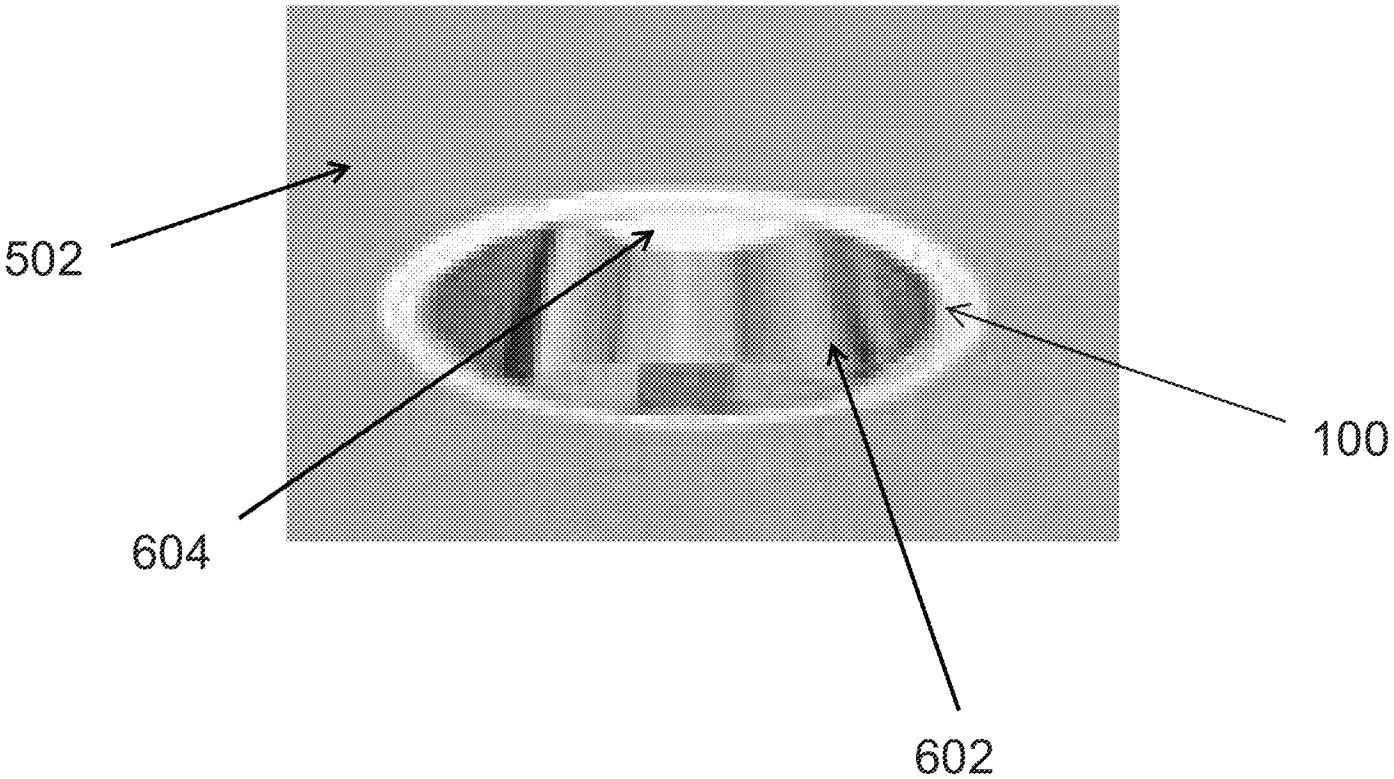
FIG. 6 illustrates the lighting fixture including the lighting fixture structure of FIG. 1 installed in a ceiling structure in accordance with an example embodiment.

In some example embodiments, the lighting fixture structure 100 may be included in a recessed lighting fixture (shown in FIG. 6). For example, the lighting fixture structure 100 may be installed in a ceiling structure of a house or a building. To illustrate, the lighting fixture structure 100 or a lighting fixture that includes the lighting fixture structure 100 may be installed in a ceiling structure such that a substantial portion of the lighting fixture structure 100 is recessed behind a ceiling. For example, when the lighting fixture structure 100 is recessed behind a ceiling, the flange 110 may be on one side of the ceiling (for example, abutted against the ceiling) facing a floor, and the arm 108, the junction box 106, and a substantial portion of the housing 102 including the housing top 104 may be on an opposite side of the ceiling hidden from view from below the ceiling. In some example embodiments, the lighting fixture structure 100 may also be installed in a wall or another structure of, for example, a house or a building. In some example embodiments, because the junction box 106 is rotatable along with the arm 108 as described above, the lighting fixture structure 100 may be installed with more ease and faster than a junction box that is not rotatable.

Although the housing 102 is shown in FIG. 1 as having a substantially cylindrical shape, in alternative embodiments, the housing 102 may have other shapes without departing from the scope of this disclosure. For example, in some alternative embodiments, the housing 102 may have a rectangular cross-section. Further, although FIG. 1 shows the arm 108 attached to the housing top 102, in alternative embodiments, the arm 108 may be attached to other parts of the housing 102. For example, in some example embodiments, the housing top 104 may be omitted, and the arm 108 may be attached to another part of the housing 102.

In some alternative embodiments, the arm 108 may have shapes other than shown in FIG. 1 without departing from the scope of this disclosure. For example, at least a portion of the arm 108 may be rounded. Further, the arm 108 may be attached to the junction box 106 at a different location of the junction box 106 than shown in FIG. 1. For example, the arm 108 may be attached at the top or bottom portions of the junction box 108. The junction box 106 may also have shapes other than shown in FIG. 1 without departing from the scope of this disclosure. Further, in some example embodiments, the flange 110 may be omitted from the lighting fixture structure 100.

Figure 2:
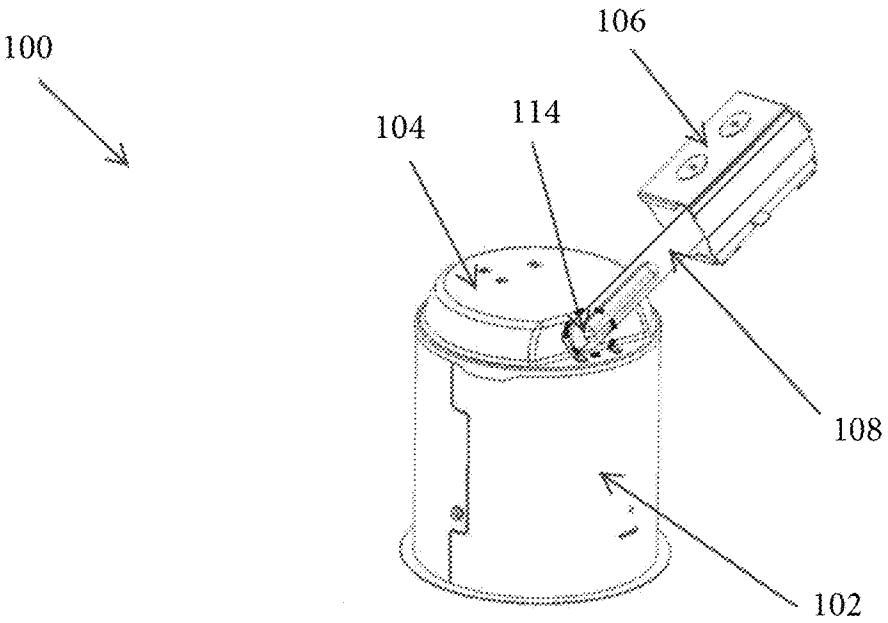
FIG. 2 illustrates the lighting fixture structure of FIG. 1 with the junction box in another rotational position in accordance with an example embodiment.

FIG. 2 is illustrates the lighting fixture structure 100 of FIG. 1 with the junction box 106 in another rotational position in accordance with an example embodiment. The arm 108 is rotatably attached to the housing 104, and the junction box 106 is fixedly attached to the arm 108. The junction box 106 and the arm 108 are rotatable between a first rotational position (for example, the substantially horizontal position illustrated in FIG. 1) and a second rotational position illustrated in FIG. 2. As illustrated in FIG. 2, the junction box 106 and the arm are rotated such that the junction box 106 is at a different rotational position as compared to the position of the junction box 106 shown the FIG. 1. For example, the junction box 106 and the arm 108 may be rotated about the attachment area 114 approximately 30 degrees relative to the substantially horizontal position of the junction box 106 and the arm 108 shown in FIG. 1.

In some example embodiments, the junction box 106 and the arm 108 may be rotatable about the attachment area 114, for example, above the substantially horizontal position of the junction box 106 and the arm 108 shown in FIG. 1. In alternative embodiments, the junction box 106 and the arm 108 may be rotatable about the attachment area 114 in a range that includes rotational positions that are above and below the substantially horizontal position of the arm 108 shown in FIG. 1. In some example embodiments, the range of rotational positions of the junction box 106 and the arm 108 may not include the substantially horizontal position of the arm 108 shown in FIG. 1. For example, the junction box 106 and the arm 108 may be rotatable in a range of rotational positions that are above the substantially horizontal position of the arm 108 shown in FIG. 1. In some example embodiments, the junction box 106 and the arm 108 may be rotatable in a range of less than 20 degrees, approximately 45 degrees, approximately 90 degrees, or approximately 180 degrees. Alternatively, the junction box 106 and the arm 108 may be rotatable within other ranges.

Figure 3:
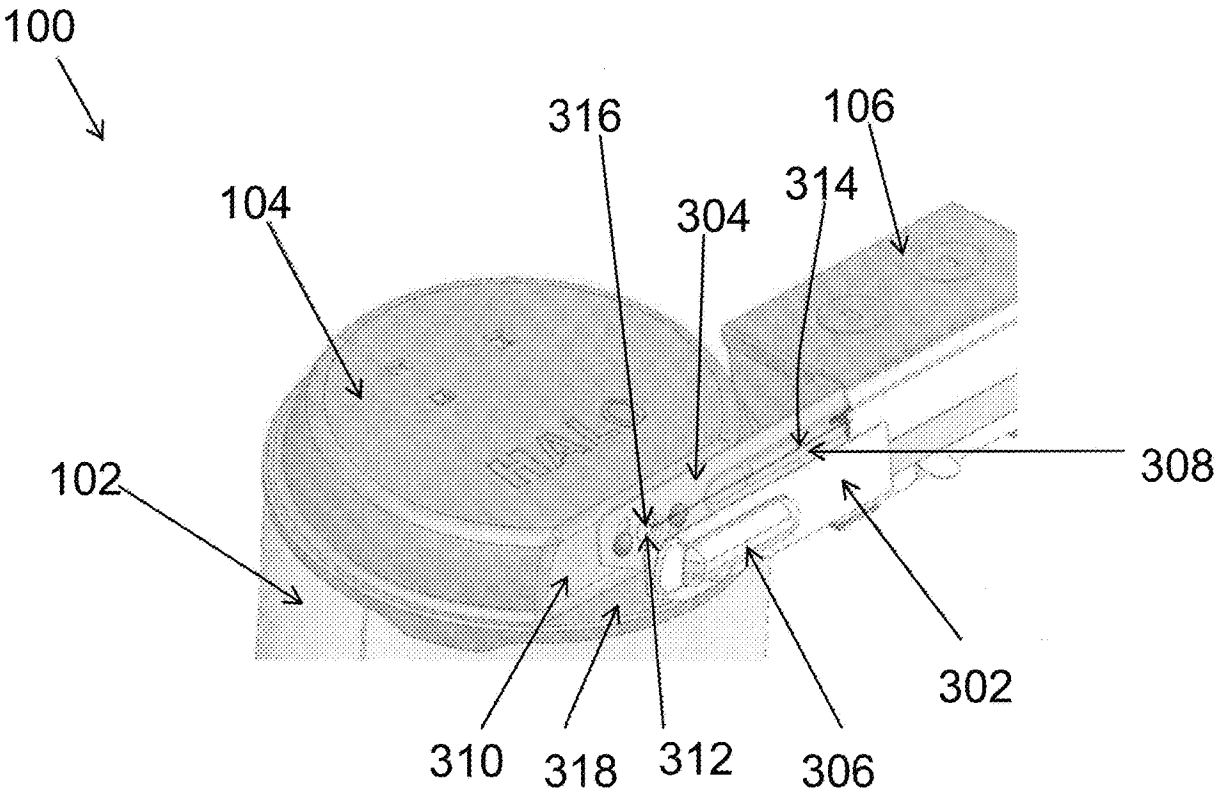
FIG. 3 illustrates an exploded view of an arm of the lighting fixture structure of FIG. 1 in accordance with an example embodiment.

FIG. 3 illustrates an exploded view of the arm 108 of the lighting fixture structure 100 of FIG. 1 in accordance with an example embodiment. As illustrated in FIG. 3, the arm segment 304 may be rotatably attached to an attachment area 310 of the housing top 104 of the housing 102. In some example embodiments, the attachment area 310 of the housing top 104 may have a substantially flat surface. Alternatively, the attachment area 310 may have a curved surface or a combination of flat and curved surfaces. In some example embodiments, the housing top 104 includes a base 318. For example, the arm segment 304 may be in contact with the base 318 when the arm segment 304 is in a substantially horizontal position shown in FIG. 3.

As illustrated in FIG. 3, the arm 108 may include an arm cover 302 and an arm segment 304. The arm cover 302 includes a wireway 306, and the arm segment 304 includes a wireway 308. The wireways 306, 308 are used for routing one or more electrical wires 314 between the junction box 106 to the housing 102. For example, a portion of the one or more electrical wires 314 may be routed in the wireway 308, and another portion of the one or more electrical wires 314 may be routed in the wireway 306. In some alternative embodiments, the wireways 306, 308 may be omitted from the arm 108, and the one or more electrical wires 314 may be routed outside of the arm 108.

As illustrated in FIG. 3, the arm segment 304 may include an opening 312 that is at least partially overlapped with an opening 316 in the housing top 104. For example, the one or more electrical wires 314 may be routed through the opening 312 and the opening 316 between the inside of the housing 102 and the junction box 106. In some example embodiments, the wireway 306 may be positioned over the openings 312, 306 on the outside of the housing top 104 such that the one or more electrical wires 314 are routed between the wireway 306 and the inside of the housing 102 through the openings 312, 316.

Although the housing top 104 is shown as being substantially dome shaped, in alternative embodiments, the housing top 104 may have other shapes without departing from the scope of this disclosure. For example, in some example embodiments, the housing top 104 may have a substantially rectangular cross-section.

Figure 4A:
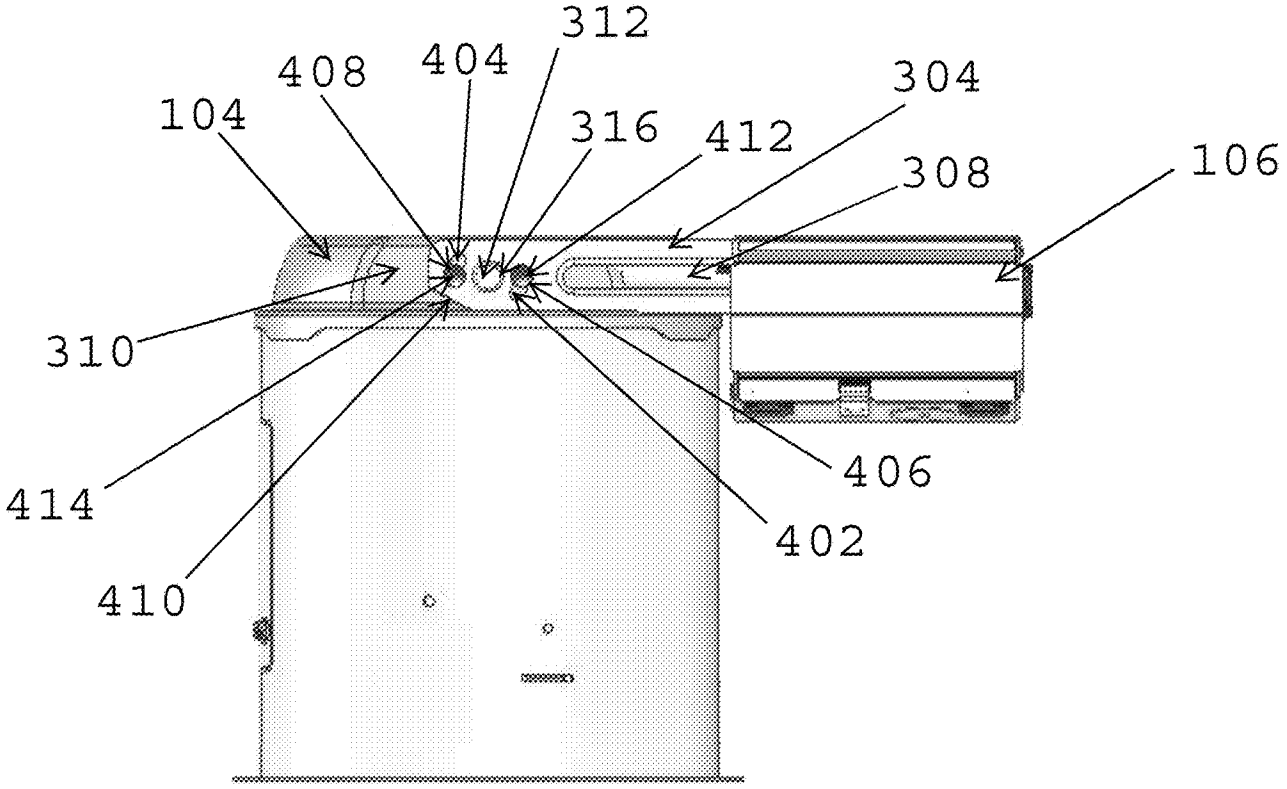
FIGS. 4A and 4B are side views of the lighting fixture structure of FIG. 1 illustrating rotational attachment details in accordance with an example embodiment.
Figure 4B:
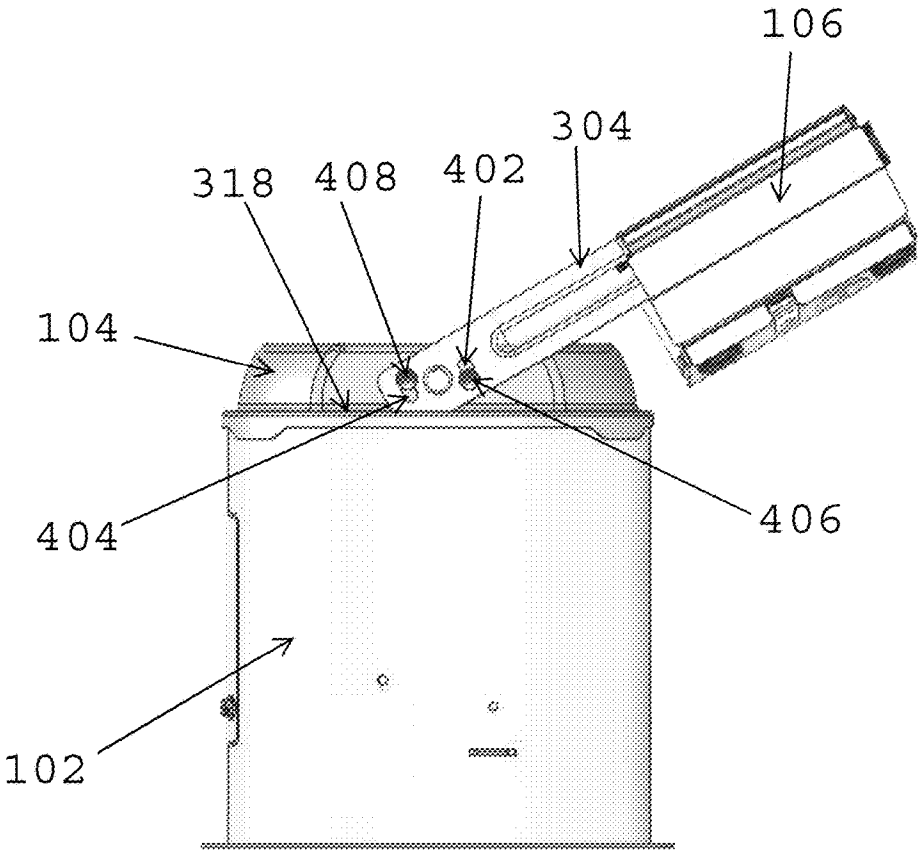

FIGS. 4A and 4B are side views of the lighting fixture structure 100 of FIG. 1 illustrating details of the attachment area 114 in accordance with an example embodiment. As illustrated in FIGS. 4A and 4B, the arm segment 304 includes arcuated slots 402, 404 that have substantially the same curvature. A pin 406 extends through the arcuated slot 402, and another pin 408 extends through the arcuated slot 404. The pins 406, 408 may be fixedly attached to the housing 102. In particular, the pins 406, 408 may be fixedly attached to the attachment area 310 of the housing top 104. To assemble the lighting fixture structure 100, the arm segment 304 may be attached to the housing 102 by inserting each pin 406, 408 through the respective arcuated slot 402, 404 of the arm segment 304. The pins 406, 408 may be attached to the housing top 104 by inserting the pin 406 through the arcuated slot 402 of the arm segment 304 and by inserting the pin 408 through the arcuated slot 404 of the arm segment 304. For example, each pin 406, 408 may be attached to respective attachment holes (not shown) in the housing top 104 through the respective one of the arcuated slots 402, 404.

In some example embodiments, each pin 406, 408 may have a head segment 412, 414, respectively, that has a dimension (e.g., a diameter) that is larger than the width of the arcuated slots 402, 404 to prevent the arm segment 304 from detaching from the housing 102. In some example embodiments, a respective structure (e.g., a nut) (not shown) may be attached to each pin 406, 408 on the inside of the housing 102 to prevent the pins 406, 408 from detaching from the housing 102. In some alternative embodiments, the pins 406, 408 may first be attached to the housing top 104, and the arm segment 304 may be subsequently attached to the housing 102 by inserting the pins 406, 408 that are already attached to the housing top 104 into the arcuated slots 402, 404, respectively. After the arm segment 304 is attached to the housing 102, the one or more electrical wires 314 shown in FIG. 3 may be routed between the junction box 106 and the inside of the housing 102 through openings 312, 316. For example, the one or more electrical wires 314 may be routed in the wireway 308 and the wireway 306 (shown in FIG. 3).

As illustrated in FIGS. 4A and 4B, the arm segment 304 along with the junction box 106 may be rotated with respect to the pins 406, 408 as positions of the pins 406, 408 within the respective arcuated slot 402, 404 change. To illustrate, when the arm segment 304 and the junction box 106 are in the substantially horizontal position shown in FIG. 4A (corresponding to the substantially horizontal position of the junction box 106 and the arm 108 shown in FIG. 1), the pin 406 is at the top end of the arcuated slot 402, and the pin 408 is at the bottom end of the arcuated slot 404. When the arm segment 304 along with the junction box 106 are rotated to the position illustrated in FIG. 4B, the pin 406 is at the bottom end of the arcuated slot 402, and the pin 408 is at the top end of the arcuated slot 404.

Referring to FIGS. 1, 4A, and 4B, in some example embodiments, the range of rotation of the arm 108 may depend on the size of the arcuated slots 402, 404. For example, the arcuated slots 402, 404 may be longer than shown in FIGS. 4A and 4B to allow a greater range of rotation of the junction box 106 and the arm 108. In some alternative embodiments, the length of the arcuated slots 402, 404 may be smaller than shown in FIGS. 4A and 4B for a lesser range of rotation of the junction box 106 and the arm 108.

In some example embodiments, the arm segment 304 may have a chamfered edge 410. The chamfered edge 410 of the arm segment 304 allows the arm 108 to be rotated when the arm segment 304 is attached to the housing 102 at a relatively lower location of the attachment area 310. To illustrate, the chamfered edge 410 may provide adequate spacing between the arm segment 304 and the base 318 to allow the rotation of the arm 108 within an acceptable or desired rotational range. The chamfered edge 410 may also enable the attachment area 310 to have a smaller vertical dimension (height) between the base 318 and the top of the housing top 304 by eliminating a need to attach the arm segment 304 to the housing 102 farther from the base 318 than shown in FIGS. 4A and 4B.

In some alternative embodiments, the arm segment 304 may be attached to the housing 102 at a relatively higher location of the attachment area 310 than shown in FIGS. 4A and 4B. For example, when a larger rotational range of the arm is desired, attachment of the arm segment 304 at a higher location of the attachment area 310 may provide adequate space for the arm 108 to rotate in a relatively large range (e.g., 180 degrees) while avoiding or minimizing contact between the end portion 112 of the arm 108 and the base 318 of the housing top 104. To illustrate, the arcuated slots 402, 404 may be longer than shown in FIGS. 4A and 4B, and the pins 406, 408 may be attached to the housing top 104 at a higher location of the attachment area 310 than shown in FIGS. 4A and 4B to allow the arm 108 to rotate in a relatively larger range. In some example embodiments, the attachment area 310 of the housing top 104 may be larger than shown in FIGS. 4A and 4B to enable attachment of the arm 108 at a higher location of the attachment area 310. When the arm segment 304 is attached to the housing 102 at a relatively higher location of the attachment area 310, the chamfered edge 410 may be replaced with a rounded edge or a sharp edge.

Although two arcuated slots 402, 404 are shown in FIGS. 4A and 4B, in alternative embodiments, the arm segment 304 may include only one arcuated slot. Further, although the pins 406, 408 are used to rotatably attach the arm segment 304 to the housing 104 as described above, in some example embodiments, other means of attaching the arm segment 304 to the housing 102 may be used without departing from the scope of this disclosure. Although the housing top 104 is shown as being substantially dome shaped, in alternative embodiments, the housing top 104 may have other shapes without departing from the scope of this disclosure. For example, in some example embodiments, the housing top 104 may have a substantially rectangular cross-section. In some alternative embodiments, the housing top 104 may also have a top opening.

Figure 5A:
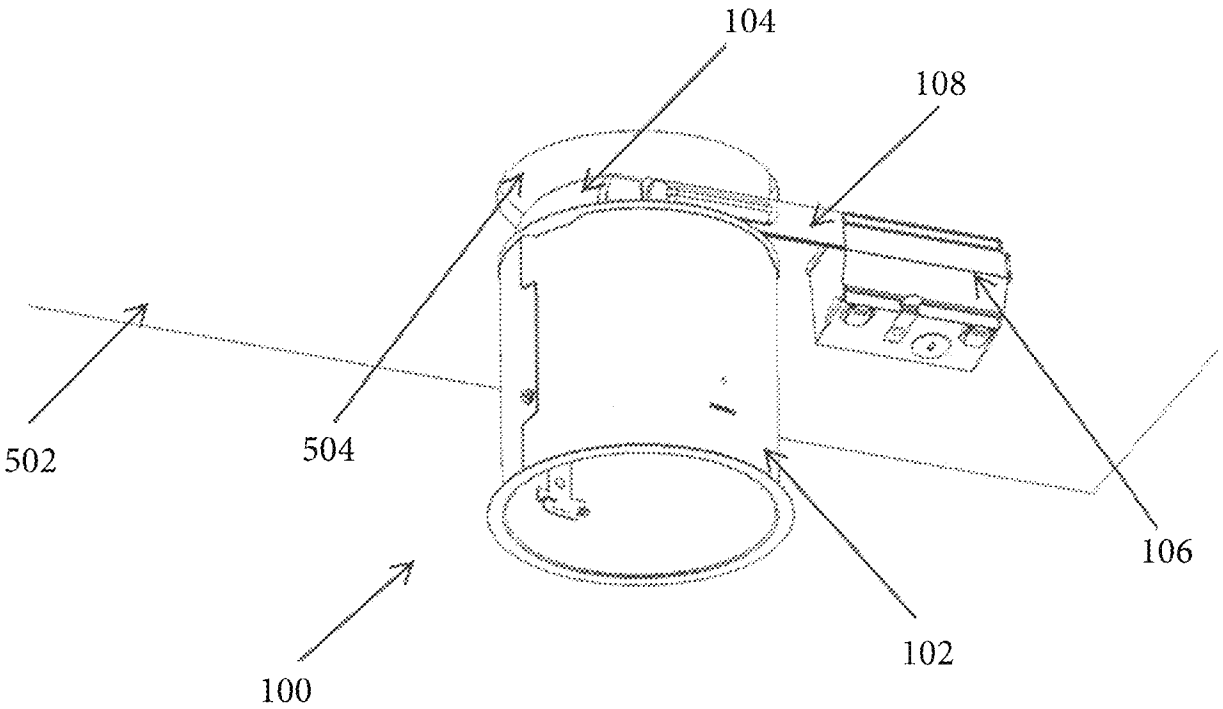
FIG. 5A-5E illustrate the lighting fixture structure of FIG. 5 at different stages of installation in a ceiling structure in accordance with an example embodiment.

FIGS. 5A-5E illustrate the lighting fixture structure 100 of FIG. 1 at different stages of installation in a ceiling 502 in accordance with an example embodiment. As illustrated in FIG. 5A, the ceiling 502 has a ceiling opening 504. For example, the ceiling opening 504 may be round to accommodate the substantially cylindrical shape of the housing 102. In some alternative embodiments, the ceiling opening 504 may have other shapes that may or may not correspond to the shape of the housing 102. As illustrated in FIG. 5A, the lighting fixture structure 100 is positioned close to the ceiling opening 504 prior the insertion of the lighting fixture structure 100 into the ceiling opening 504. In some example embodiments, power supply wires (not shown) may be connected to the junction box 106.

Figure 5B:
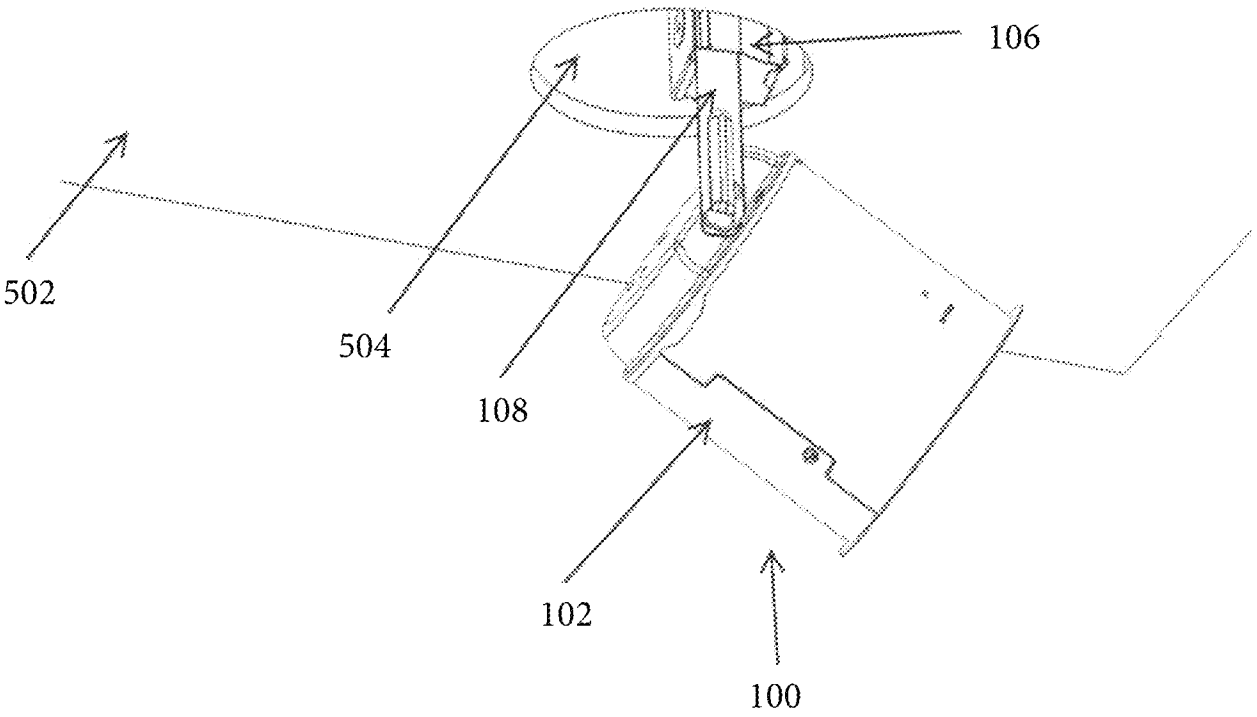
Figure 5C:
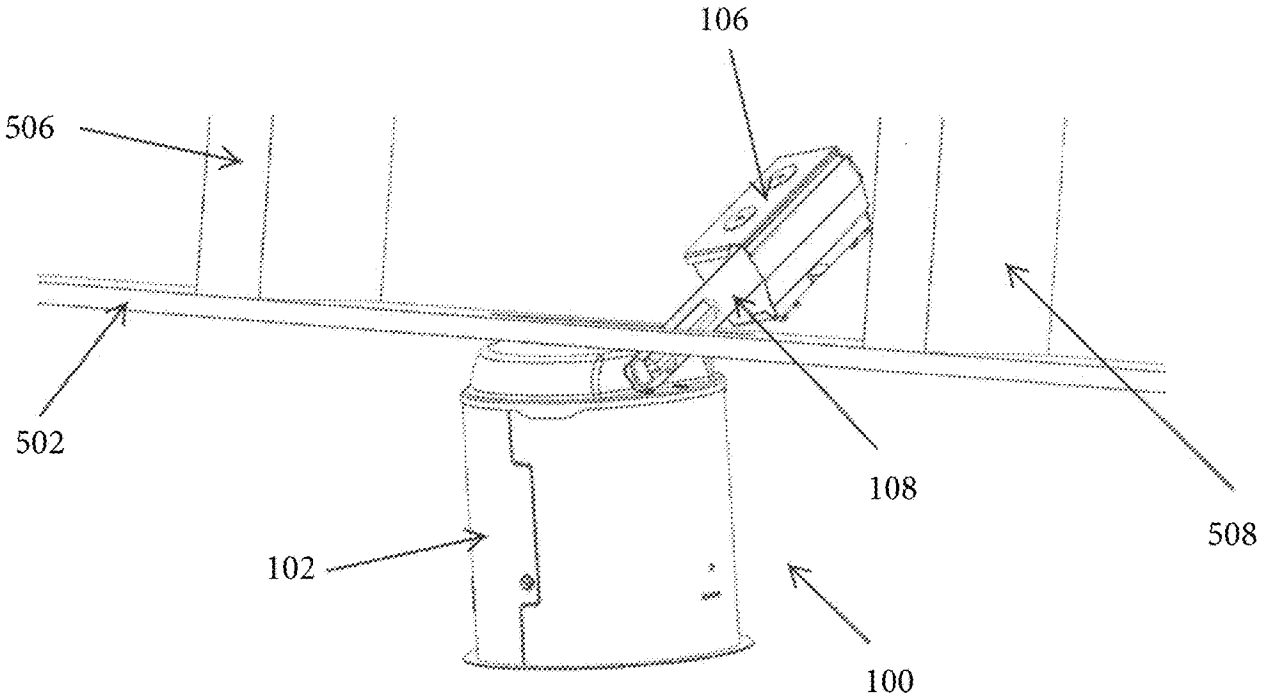
Figure 5D:
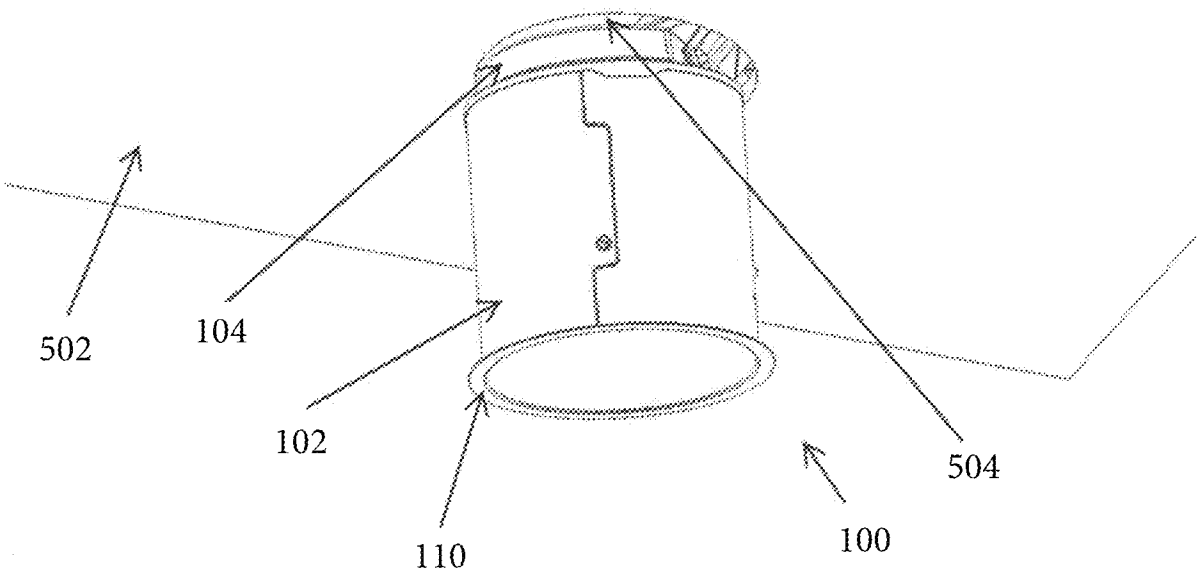
Figure 5E:
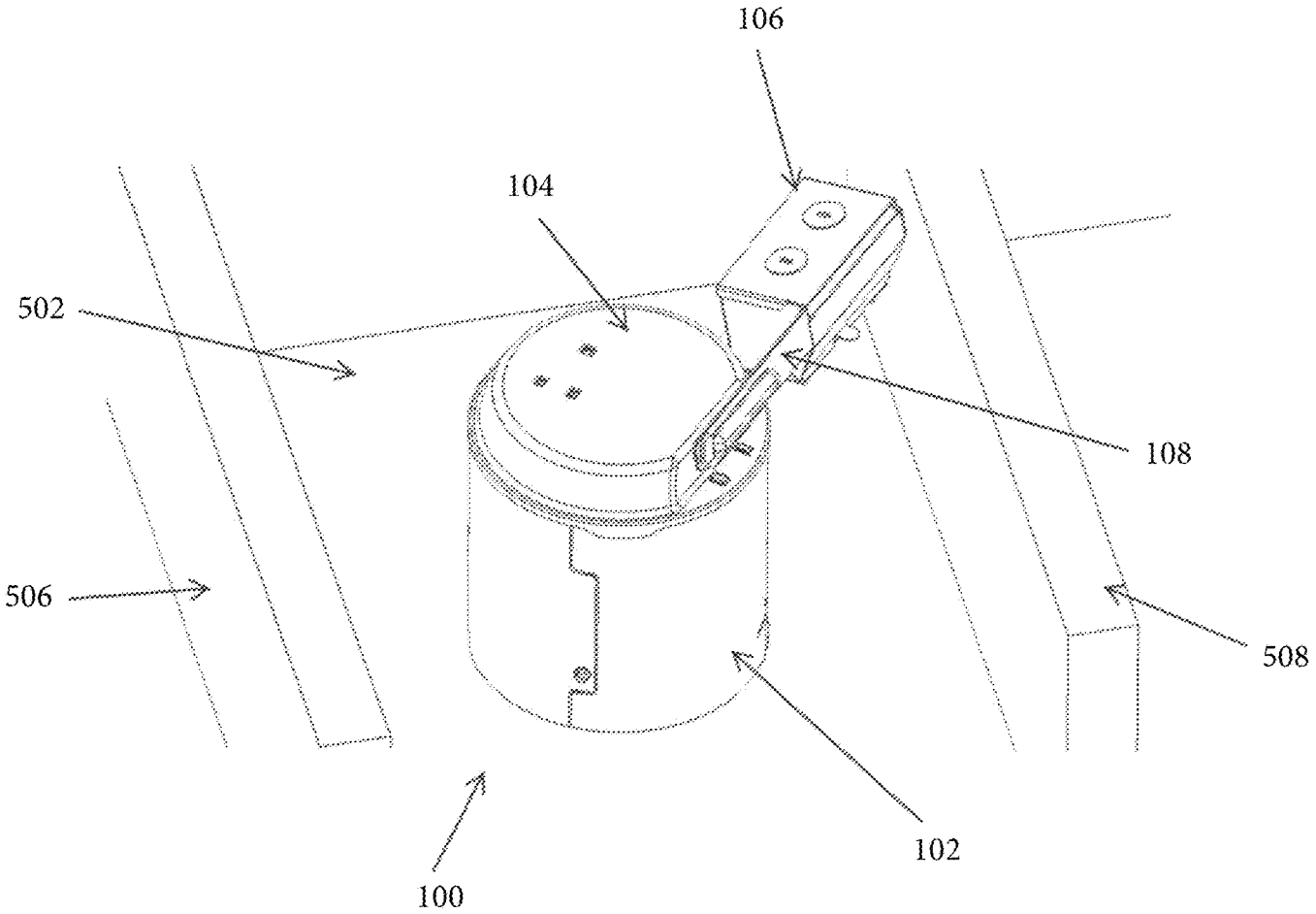

As illustrated in FIG. 5B, the junction box 106 is inserted through the ceiling opening 504. The arm 108 is rotated relative to the housing 102 such that the flange 110 of the housing 102 does not touch the ceiling 502, which may minimize damage to the ceiling 502. In FIG. 5C, the arm 304 is partially inserted through the opening 504, and the junction box 106 is positioned fully behind the ceiling 502. Ceiling structures 506, 508 may be structures such as joists that provide support to the ceiling 502. As illustrated in FIG. 5C, the junction box 106 is positioned against the ceiling structure 508. Because the arm 108 and the junction box 106 are rotatable with respect to the housing 102, the junction box 106 may be positioned at a slanted angle against the ceiling structure 508, which allows the lighting fixture structure 100 to be installed in small areas behind the ceiling 502. FIG. 5D shows the arm 108 positioned substantially behind the ceiling 502 through the ceiling opening 504. The lighting fixture structure 100 is positioned to be recessed into the ceiling 502 such that the flange 110 abuts against the ceiling 502. In FIG. 5E, the lighting fixture structure 100 is recessed behind the ceiling 502. In some example embodiments, the lighting fixture structure 100 may be rotated to a position that provides adequate space for the junction box 106 and the arm 108 to be a substantially horizontal position as shown in FIG. 5E. Alternatively, the junction box 106 and the arm 108 may be rotated such that junction box 106 remains positioned against the ceiling structure 508.

Because the arm 108 and the junction box 106 are rotatable, in some example embodiments, the distance between the perimeter of the ceiling opening 504 and the ceiling structures 506, 508 may be relatively small as compared to the distance that may be required to install a lighting fixture structure that has a fixed arm. The rotatability of the junction box 106 relative to the housing 102 enables shortening of the arm 108, which may result in material cost savings. The rotatability of the junction box 106 relative to the housing 102 also enables installation of the lighting fixture 100 in an area (e.g., behind a ceiling) that has limited cavity space or that includes fixed structures that hinder installation of lighting fixtures. Because the arm 108 and the junction box 106 are rotatable with respect to the housing 102 and because the housing 102 is rotatable with respect to the arm 108 and the junction box 106, the junction box 106 may be positioned at a non-horizontal angle against the ceiling structure 508

FIG. 6 illustrates a lighting fixture 602 including the lighting fixture structure 100 of FIG. 1 installed in a ceiling 502 in accordance with an example embodiment. For example, after the lighting fixture structure 100 is installed as illustrated in FIG. 5E, a light source 604 and other components such as reflectors may be installed in the lighting fixture structure 100. Electrical power may be provided to the light source via the one or more electrical wires 314 shown in FIG. 3. In some example embodiments, the light source 604 may be one or more light emitting diodes (LED) or other types of light source.

Although particular embodiments have been described herein in detail, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures.

What is claimed is:

1. A lighting fixture structure for a recessed lighting fixture, comprising:

a housing;

a junction box; and an arm extending between the housing and the junction box, wherein the arm is attached to the junction box, wherein the arm is attached to and rotatable about an attachment area of the housing, wherein the housing includes a housing top that extends above a cylindrical section of the housing, wherein the housing top includes a top wall and a substantially flat side wall, wherein the substantially flat side wall includes the attachment area, wherein the arm includes a wireway and a wire opening that is formed through a wall of the arm, and wherein the wireway and the wire opening are used for routing one or more electrical wires between the junction box and an inside of the housing.

2. The lighting fixture structure of claim 1, wherein the housing top includes a base section that is below the attachment area and at a top end of the cylindrical section of the housing.

3. The lighting fixture structure of claim 1, wherein the arm is made from sheet metal.

4. The lighting fixture structure of claim 2, wherein a first portion of the wireway is formed in a first section of the arm and wherein a second portion of the wireway is formed in a second section of the arm between an arm cover and a surface of the arm.

5. The lighting fixture structure of claim 2, wherein the junction box is fixedly attached to the arm such that the junction box is rotatable along with the arm.

6. The lighting fixture structure of claim 5, wherein the arm is rotatable in a range of 45 degrees.

7. The lighting fixture structure of claim 2, wherein the housing includes a second wire opening for routing the one or more electrical wires into the inside of the housing and wherein the second wire opening of the housing at least partially overlaps with the wire opening of the arm.

8. The lighting fixture structure of claim 7, wherein the second wire opening is formed in the housing top.

9. The lighting fixture structure of claim 1, wherein the arm includes an arcuated slot, wherein a pin extends through the arcuated slot, and wherein the pin is fixedly attached to the attachment area of the housing through the arcuated opening.

10. The lighting fixture structure of claim 9, wherein the arm includes a second arcuated opening, wherein a second pin extends through the second arcuated slot, and wherein the second pin is fixedly attached to the attachment area of the housing through the second arcuated opening.

11. A recessed lighting fixture, comprising:

a light source;

a housing, wherein the light source is disposed in the housing;

a junction box; and an arm extending between the housing and the junction box, wherein the arm is attached to the junction box, wherein the arm is attached to and rotatable about an attachment area of the housing, wherein the housing includes a housing top that extends above a cylindrical section of the housing, wherein the housing top includes a top wall and a substantially flat side wall, wherein the substantially flat side wall includes the attachment area, wherein the arm includes a wireway and a wire opening that is formed through a wall of the arm, and wherein the wireway and the wire opening are used for routing one or more electrical wires between the junction box and the light source.

12. The recessed lighting fixture of claim 11, wherein the housing top includes a base section that is below the attachment area and at a top end of the cylindrical section of the housing.

13. The recessed lighting fixture of claim 11, wherein the attachment area is offset inward from a perimeter of the cylindrical section and directly above a cavity of the cylindrical section.

14. The recessed lighting fixture of claim 12, wherein a first portion of the wireway is formed in a first section of the arm and wherein a second portion of the wireway is formed in a second section of the arm.

15. The recessed lighting fixture of claim 12, wherein the housing includes a second wire opening for routing the one or more electrical wires to the inside of the housing, and wherein the second wire opening of the housing at least partially overlaps with the wire opening of the arm.

16. The recessed lighting fixture of claim 11, wherein the arm includes an arcuated opening and wherein a pin is fixedly attached to the attachment area of the housing through the arcuated opening.

17. The recessed lighting fixture of claim 16, wherein the arm includes a second arcuated opening and wherein a second pin is fixedly attached to the attachment area of the housing through the second arcuated opening.

18. A method of assembling a lighting structure, comprising:

attaching a junction box to an arm;

attaching the arm rotatably to an attachment area of a housing such that the arm is rotatable about the attachment area of the housing, wherein the housing includes a housing top that extends above a cylindrical section of the housing, wherein the housing top includes a top wall and a substantially flat side wall, and wherein the substantially flat side wall includes the attachment area; and routing one or more electrical wires between the junction box and an inside of the housing through a wireway of the arm, a wire opening of the arm, and a wire opening of the housing, wherein the wire opening of the housing at least partially overlaps the opening of the arm that is formed through a wall of the arm.

19. The method of claim 18, wherein attaching the arm rotatably to the housing comprises:

inserting a pin through an arcuated opening of the arm; and attaching the pin to the housing through the arcuated opening.

20. The method of claim 19, wherein attaching the arm rotatably to the housing comprises:

inserting a second pin through a second arcuated opening of the arm; and attaching the second pin to the housing through the second arcuated opening, wherein the wire opening of the arm is between the arcuated opening and the second arcuated opening.

* * * * *